US008328301B2

(12) United States Patent
Lee et al.

(10) Patent No.: US 8,328,301 B2
(45) Date of Patent: Dec. 11, 2012

(54) REFRIGERATOR

(75) Inventors: Suk-Min Lee, Gwangju (KR); Hyun-Tae Chu, Gwangju (KR); Young-gwi Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 164 days.

(21) Appl. No.: 12/659,661

(22) Filed: Mar. 16, 2010

(65) Prior Publication Data

US 2011/0050066 A1 Mar. 3, 2011

(30) Foreign Application Priority Data

Aug. 27, 2009 (KR) ..... 10-2009-0080064
Oct. 26, 2009 (KR) ..... 10-2009-0101921

(51) Int. Cl.
*A47B 96/04* (2006.01)
*A47B 95/02* (2006.01)
*E05B 3/00* (2006.01)

(52) U.S. Cl. ..... 312/402; 312/332.1; 292/336.3; 292/DIG. 71

(58) Field of Classification Search ..... 312/404, 312/402, 291, 301, 296, 332.1; 292/336.3, 292/DIG. 71; 49/478.1
See application file for complete search history.

(56) References Cited

U.S. PATENT DOCUMENTS

| | | | | | |
|---|---|---|---|---|---|
| 2,659,115 | A | * | 11/1953 | Anderson et al. | 49/277 |
| 5,908,228 | A | * | 6/1999 | Lee | 312/405 |
| 5,915,805 | A | * | 6/1999 | Lee | 312/405 |
| D430,174 | S | * | 8/2000 | Negrao et al. | D15/89 |
| D507,284 | S | * | 7/2005 | Seo | D15/85 |
| 2003/0090187 | A1 | * | 5/2003 | Kawamura et al. | 312/401 |
| 2004/0189015 | A1 | * | 9/2004 | Antos et al. | 292/180 |
| 2005/0200253 | A1 | * | 9/2005 | Wissinger et al. | 312/405 |
| 2008/0000052 | A1 | * | 1/2008 | Hong et al. | 16/382 |
| 2008/0163462 | A1 | * | 7/2008 | King | 16/412 |
| 2008/0284301 | A1 | * | 11/2008 | Kim | 312/405 |
| 2009/0179540 | A1 | * | 7/2009 | Seo | 312/405 |
| 2009/0205357 | A1 | * | 8/2009 | Lim et al. | 62/441 |
| 2010/0101267 | A1 | * | 4/2010 | Jung et al. | 62/449 |

* cited by examiner

*Primary Examiner* — David Dunn
*Assistant Examiner* — Ryan A Doyle
(74) *Attorney, Agent, or Firm* — Staas & Halsey LLP

(57) ABSTRACT

Disclosed is a refrigerator including a main body cabinet forming a storage compartment including a front opening, and a drawer type door entering and exiting the storage compartment to open and close the front opening, the drawer type door including: a basket entering and exiting the storage compartment; a door main body coupled to a front area of the basket to open and close the front opening of the storage compartment; a pocket unit formed at an upper wall surface of the door main body to receive a user's hand; a handle member adjacent to the pocket unit to rotate in forward and backward directions with respect to the door main body; and a pair of sliders reciprocating between an opening position and a closing position.

14 Claims, 5 Drawing Sheets

REFRIGERATOR

CROSS-REFERENCE TO RELATED APPLICATION

This application claims the benefit of Korean Patent Application No. 10-2009-0080064, filed on Aug. 27, 2009 in the Korean Intellectual Property Office, and No. 10-2009-0101921, filed on Oct. 26, 2009, the disclosures of which are incorporated herein by reference.

BACKGROUND

1. Field

The embodiments relate to a refrigerator, and more particularly, to a refrigerator improving a door configuration to easily open a door.

2. Description of the Related Art

In general, a refrigerator is an apparatus to store food in a fresh state for a long time, and includes a main body cabinet forming a storage compartment, and a door opening and closing the storage compartment.

In the conventional refrigerator, since the door is heavy, and there is a pressure difference between an inner part and an outer part of the storage compartment due to decrease of the temperature of the storage compartment, a large force is necessary to open the door.

SUMMARY

Accordingly, it is an aspect to provide a refrigerator having an easily opened door, and also with an enhanced external appearance.

Additional aspects and/or advantages will be set forth in part in the description which follows and, in part, will be apparent from the description, or may be learned by practice of the embodiments.

The foregoing and/or other aspects can be achieved by providing a refrigerator including a main body cabinet forming a storage compartment, the main body cabinet including a front opening, and a drawer type door entering and exiting the storage compartment to open and close the front opening, the drawer type door including a basket which enters and exits the storage compartment in forward and backward direction; a door main body of a planar shape which is coupled to a front area of the basket to open and close the front opening of the storage compartment; a pocket unit which is formed in an upper wall surface of the door main body to allow a hand of a user to be inserted; a handle member which is provided to be adjacent to the pocket unit to rotate in forward and backward directions with respect to the door main body; and a pair of sliders which reciprocate depending on a rotation of the handle member between an opening position protruding from the door main body to press front surfaces of lateral walls of the storage compartment, and a closing position accommodated in an inner part of the door main body.

The handle member may include a lever which is accommodated in the pocket unit; a hinge unit which couples the lever with respect to the door main body to rotate in a forward and backward direction; and a pressing unit which moves in the opposite direction to the lever about the hinge unit depending on a rotation of the lever, and presses and releases the slider.

There may be a pair of the pressing units on opposite sides in a widthwise direction of the door main body. The hinge unit may be provided in a plurality of areas of the lever along a widthwise direction of the door main body. The hinge unit may be applied with a lubricating oil.

The hinge unit may include a hinge pivot provided to the lever and having an axial direction along a widthwise direction of the door main body, and a hinge pivot coupling unit coupling the hinge pivot to the door main body, and the hinge pivot coupling unit and the door main body are formed with hinge pivot accommodating grooves facing each other to be coupled each other to surround the hinge pivot.

The lever may include a lever main body, a surface of which is disposed in a surface direction of the door main body to be distanced from a front wall surface of the pocket unit in the opening position; and a lever cover which is bent from an end area of the lever main body to cover between a front wall surface of the pocket unit and the lever main body.

The drawer type door may further include an elastic member which supplies an elastic force to the handle member or the slider so that the slider can maintain the closing position.

The foregoing and/or other aspects are achieved by providing a refrigerator including a main body cabinet forming a storage compartment, the main body cabinet including a front opening, and a drawer type door entering and exiting the storage compartment to open and close the front opening, the drawer type door including: a basket which enters and exits the storage compartment in forward and backward directions; a door main body of a planar shape which is coupled to a front area of the basket to open and close the front opening of the storage compartment; a pocket unit which is formed in an upper wall surface of the door main body to allow a hand of a user to be inserted; a handle member which is provided to be adjacent to the pocket unit, and includes a hinge unit provided to a plurality of areas along a widthwise direction of the door main body to rotate in forward and backward directions with respect to the door main body; and a pair of sliders which reciprocate depending on a rotation of the handle member between an opening position protruding from the door main body to press front surfaces of lateral walls of the storage compartment, and a closing position accommodated in an inner part of the door main body.

The handle member may include a lever which is accommodated in the pocket unit; and a pressing unit which moves in the opposite direction to the lever about the hinge unit depending on a rotation of the lever, and presses and releases the slider.

There may be a pair of pressing units on the opposite sides in a widthwise direction of the door main body.

The hinge unit may be applied with a lubricating oil.

The hinge unit may include a hinge pivot provided to the lever and having an axial direction along a widthwise direction of the door main body, and a hinge pivot coupling unit coupling the hinge pivot to the door main body, and the hinge pivot coupling unit and the door main body are formed with hinge pivot accommodating grooves facing each other to be coupled to each other to surround the hinge pivot.

The lever may include a lever main body, a surface of which is disposed in a surface direction of the door main body to be distanced from a front wall surface of the pocket unit in the opening position; and a lever cover which is bent from an end area of the lever main body to cover between a front wall surface of the pocket unit and the lever main body.

The drawer type door may further include an elastic member which supplies an elastic force to the handle member or the slider so that the slider can maintain the closing position.

The foregoing and/or other aspects are also achieved by providing a refrigerator which includes a main body cabinet forming a storage compartment including a front opening, and a drawer type door entering and exiting the storage compartment to open and close the front opening, the drawer type door including: a basket which enters and exits the storage compartment in forward and backward directions; a door main body of a planar shape which is coupled to a front area of the basket to open and close the front opening of the storage compartment; a pocket unit which is formed to an upper wall surface of the door main body and having a length corresponding to a width of the door main body to allow a hand of a user to be inserted; a handle member which has a length corresponding to the pocket unit and is provided to be adjacent to the pocket unit to rotate in forward and backward directions with respect to the door main body; and a pair of sliders which reciprocate depending on a rotation of the handle member between an opening position protruding from the door main body to press front surfaces of lateral walls of the storage compartment and a closing position accommodated in an inner part of the door main body.

The handle member may include: a lever which is accommodated in the pocket unit; a hinge unit which couples the lever with respect to the door main body to rotate in forward and backward directions; and a pressing unit which moves in the opposite direction to the lever about the hinge unit depending on a rotation of the lever, and presses and releases the slider.

The pressing unit may be provided in a pair to the opposite sides in a widthwise direction of the door main body.

A lubricating oil may be applied to the hinge unit.

The hinge unit may include a hinge pivot provided to the lever and having an axial direction along a widthwise direction of the door main body, and a hinge pivot coupling unit coupling the hinge pivot to the door main body, and the hinge pivot coupling unit and the door main body may be formed with hinge pivot accommodating grooves facing each other to be coupled each other to surround the hinge pivot.

The lever may include: a lever main body, a surface of which is disposed in a surface direction of the door main body to be distanced from a front wall surface of the pocket unit in the opening position; and a lever cover which is bent from an end area of the lever main body to cover between a front wall surface of the pocket unit and the lever main body.

The drawer type door may further include an elastic member which supplies an elastic force to the handle member or the slider so that the slider can maintain the closing position.

BRIEF DESCRIPTION OF THE DRAWINGS

The embodiments will become apparent and more readily appreciated from the following description, taken in conjunction with the accompanying drawings, in which.

DETAILED DESCRIPTION

Figure 1:
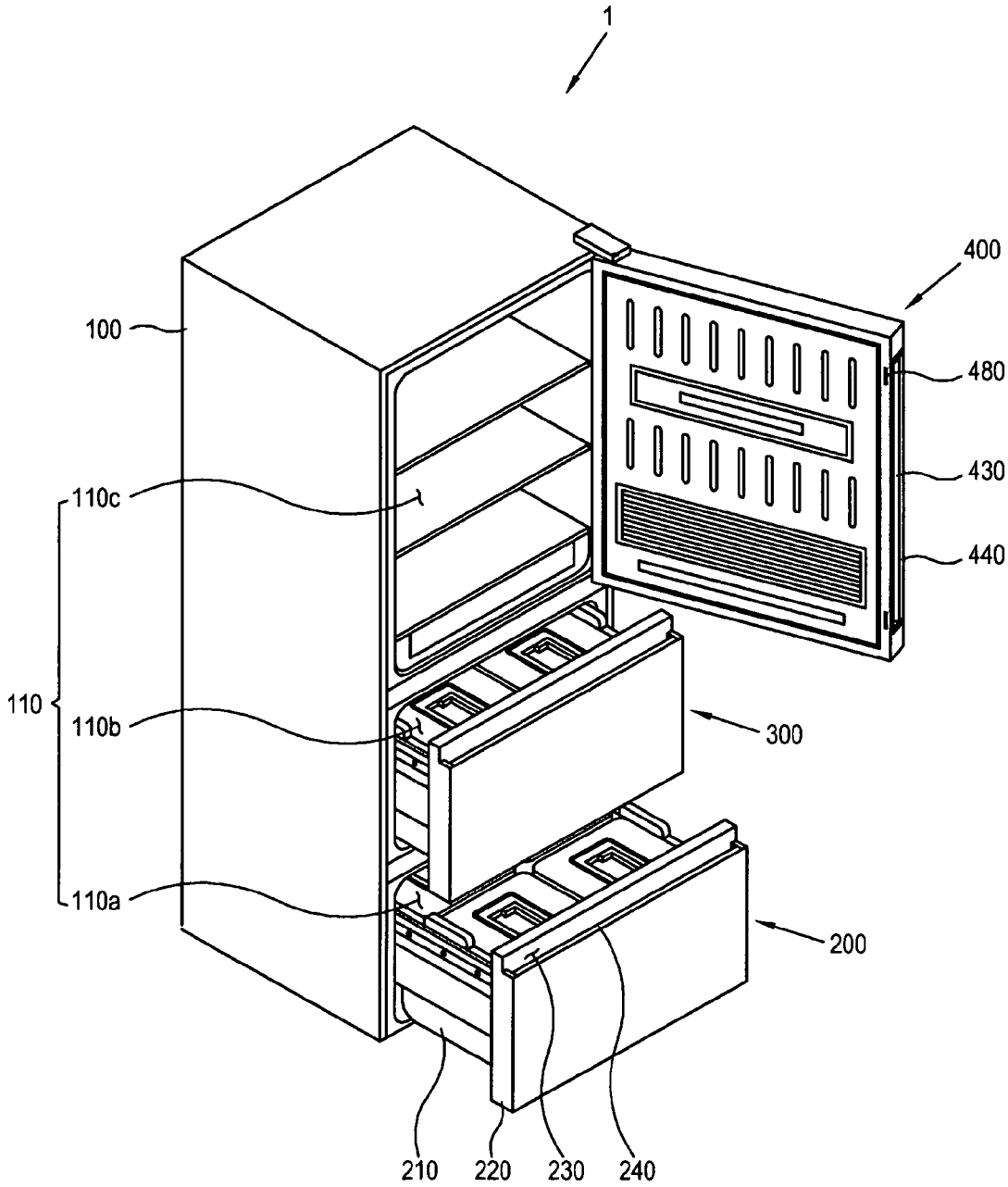
FIG. 1 is a perspective view schematically illustrating a configuration of a refrigerator according to an embodiment.

Reference will now be made in detail to the embodiments, examples of which are illustrated in the accompanying drawings, wherein like reference numerals refer to like elements throughout. The exemplary embodiments are described below for explanation by referring to the figures. Repetitive description with respect to like elements of different embodiments may be omitted for the convenience.

FIG. 1 is a perspective view schematically illustrating a configuration of a refrigerator 1 according to an embodiment.

As shown in FIG. 1, the refrigerator 1 includes a main body cabinet 100, and doors 200, 300 and 400.

The main body cabinet 100 forms a storage compartment 110 having a front opening. Three storage compartments 110 are provided vertically.

The storage compartment 110 includes a first storage compartment 110*a* at a lower area of the main body cabinet 100, a second storage compartment 110*b* at a middle area thereof, and a third storage compartment 110*c* at an upper area thereof. Each storage compartment 110*a*, 110*b* and 110*c* is partitioned by a wall.

The doors 200, 300 and 400 open and close the front opening of the storage compartments 110*a*, 110*b* and 110*c*. The doors 200, 300 and 400 include a first door 200 opening and closing the first storage compartment 110*a*, a second door 300 opening and closing the second storage compartment 110*b*, and a third door 400 opening and closing the third compartment 110*c*.

The first door 200 and the second door 300 are drawer type doors respectively entering and exiting the first storage compartment 110*a* and the second storage compartment 110*b*, and the third door 400 is a rotating door rotating with respect to the main body cabinet 100 to open and close the third storage compartment 110*c*.

Figure 2:
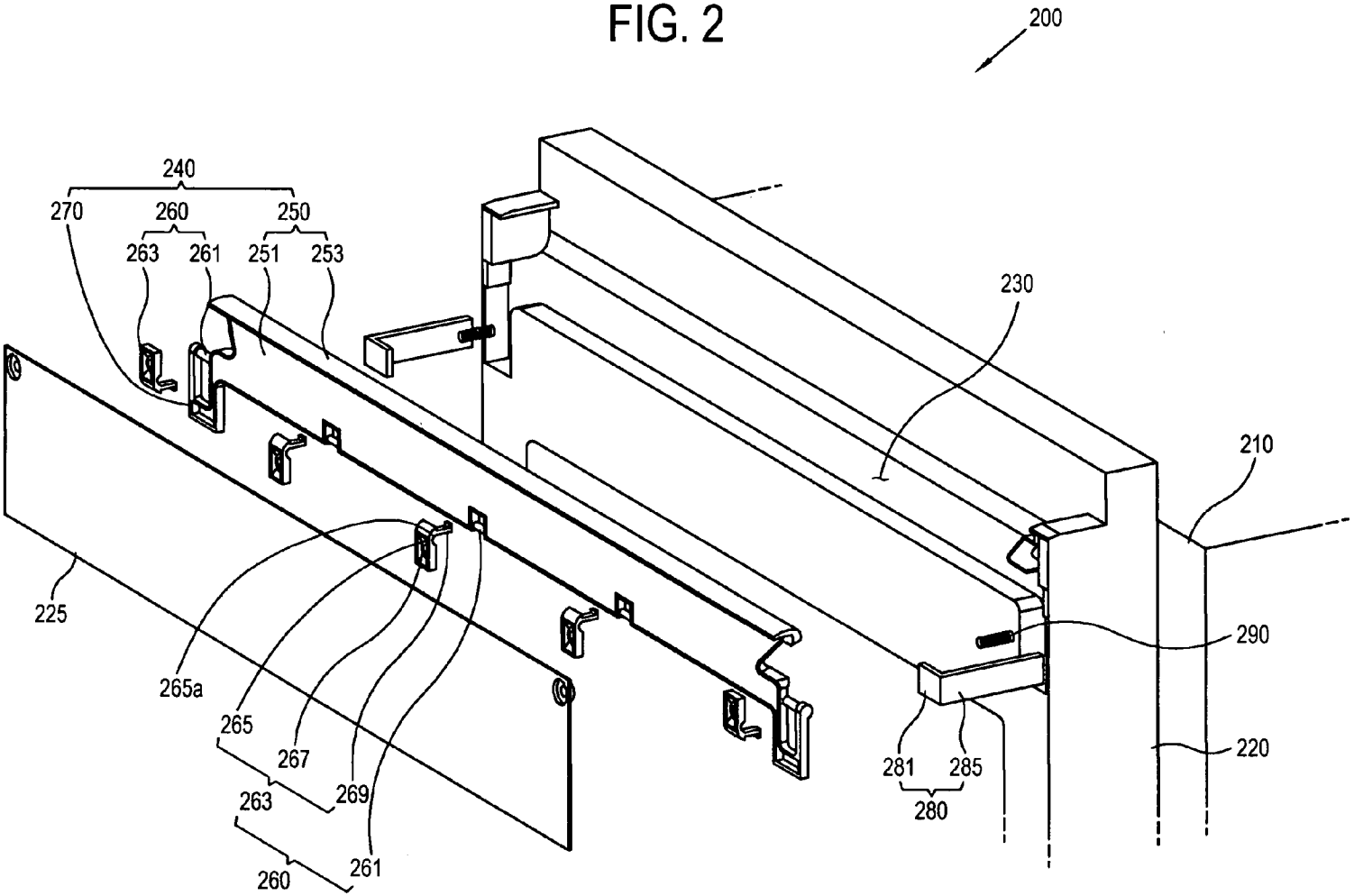
FIG. 2 is an exploded perspective view of a first door of the refrigerator according to the embodiment.
Figure 3:
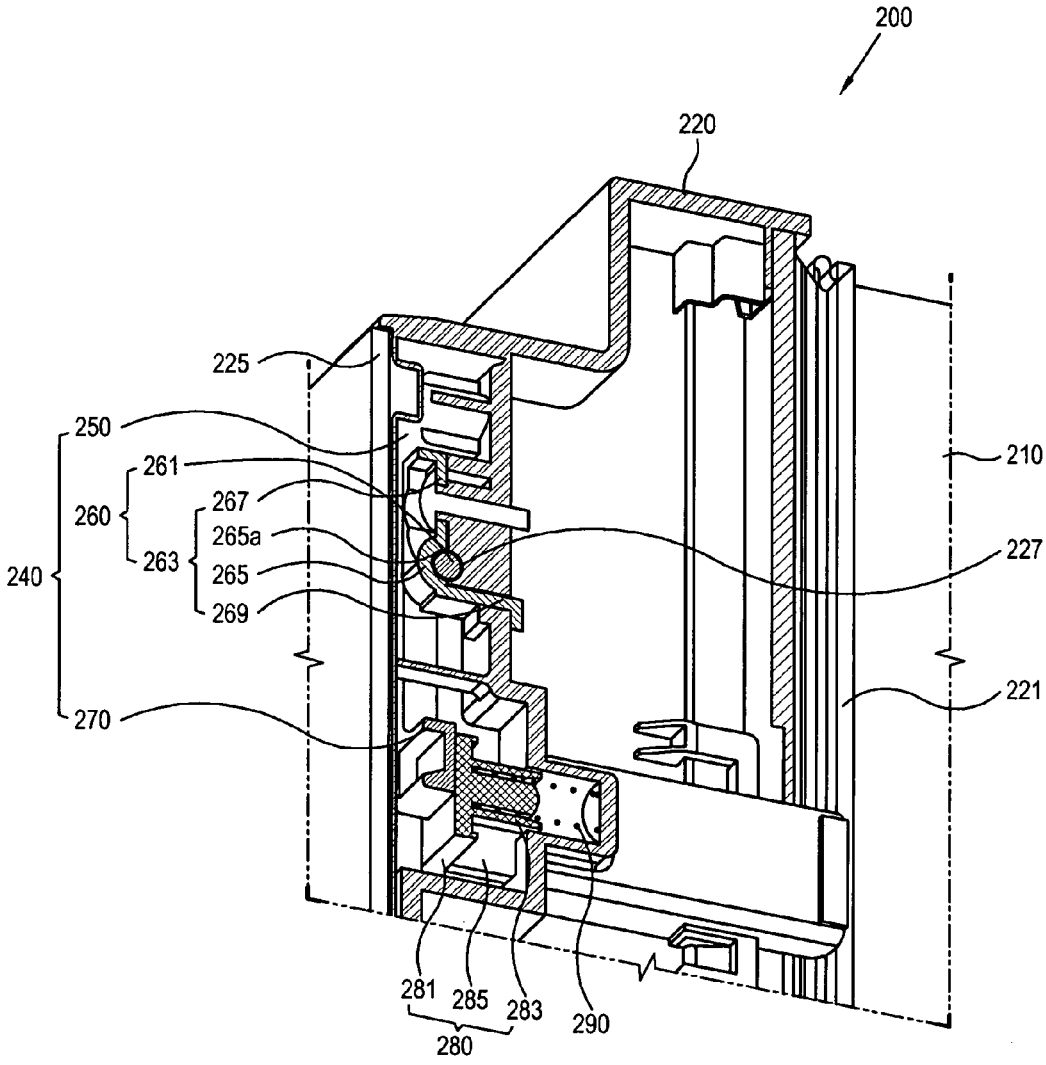
FIG. 3 is a cutaway perspective view of the first door of the refrigerator according to the embodiment.

Hereinafter, the first door 200, which is a drawer type door, will be described in detail by referring to FIGS. 2 and 3. FIG. 2 is an exploded perspective view of the first door 200 of the refrigerator 1, and FIG. 3 is a cutaway perspective view of the first door 200.

Figure 4A:
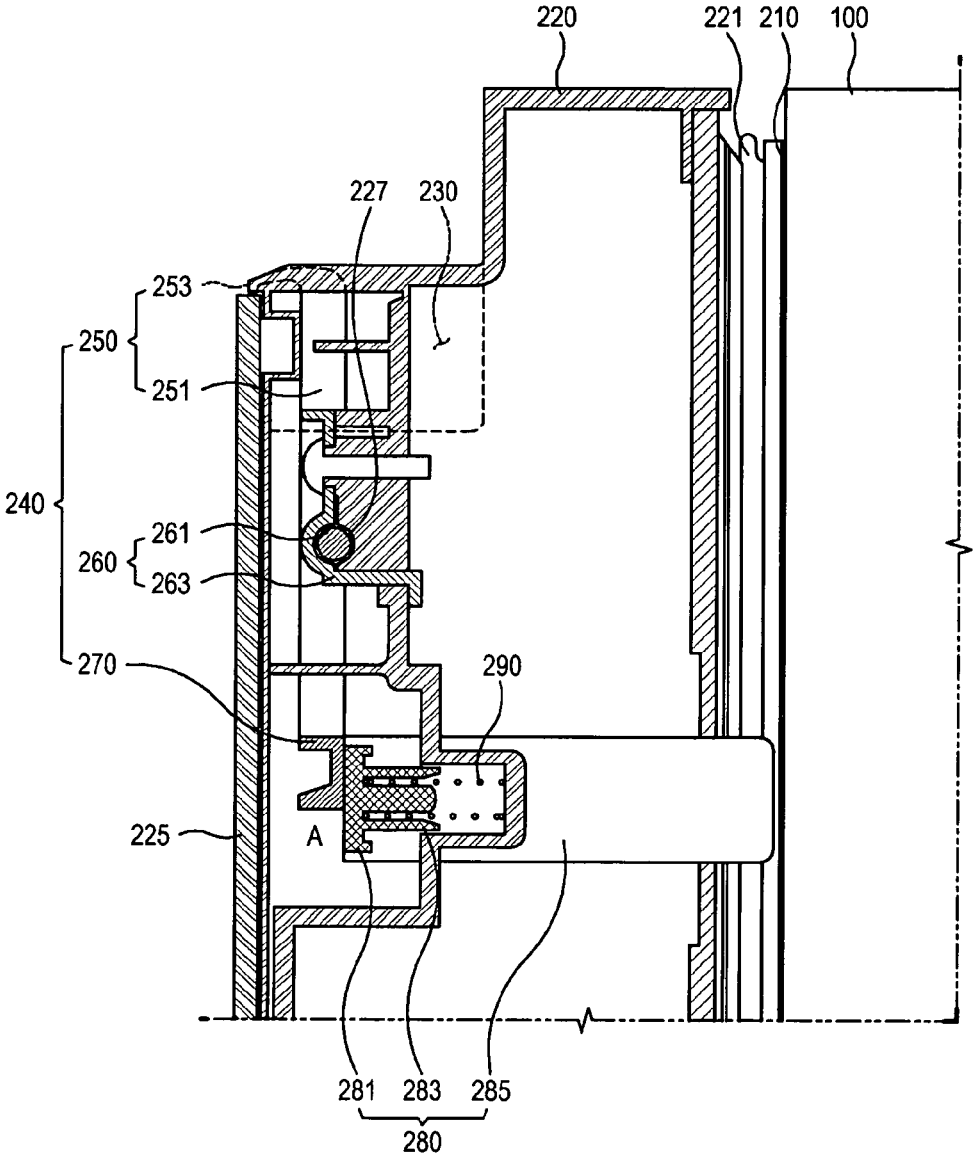
FIGS. 4A and 4B are sectional views illustrating an opening and closing operation state of the first door of the refrigerator according to the embodiment.
Figure 4B:
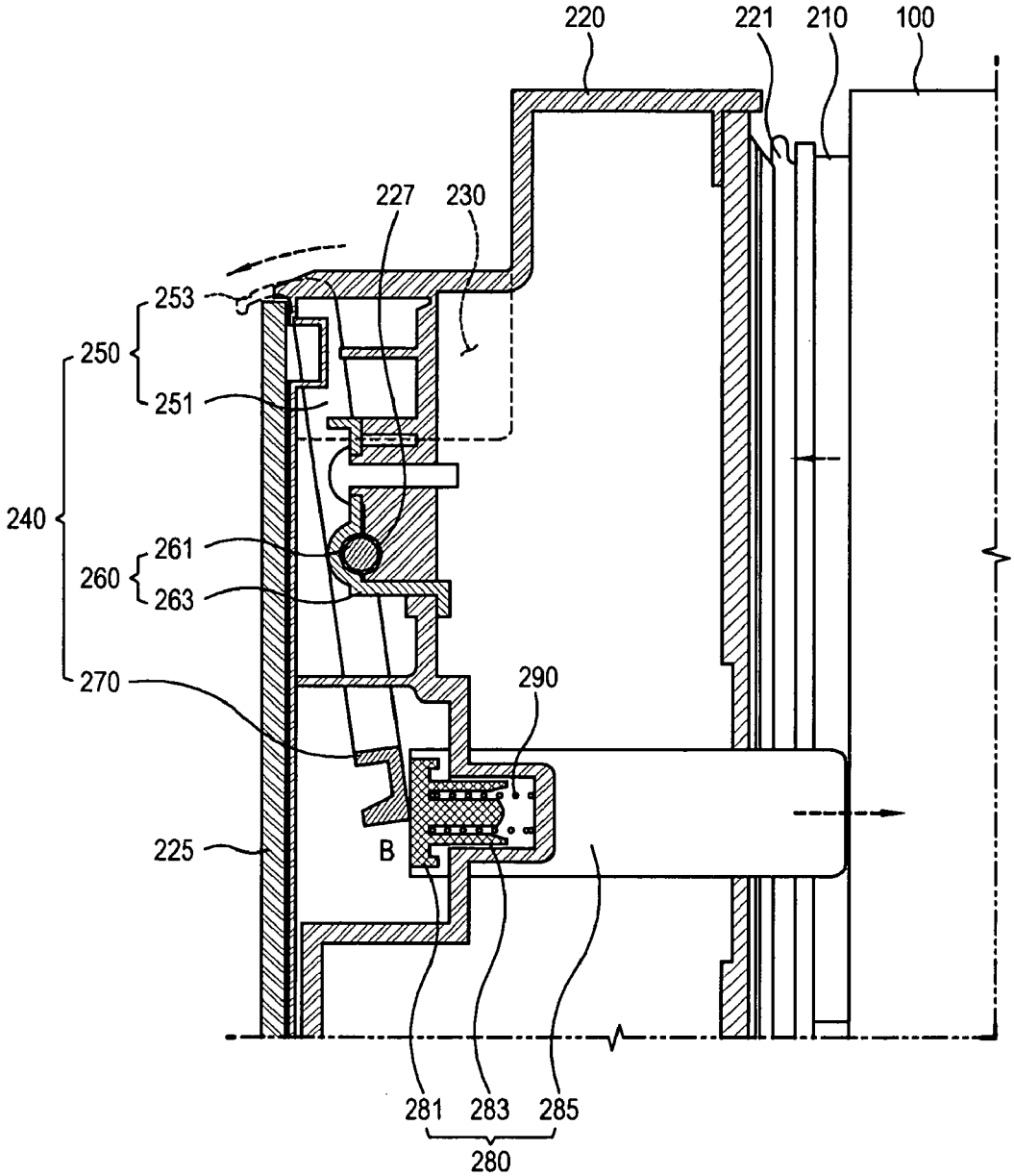

The first door 200 includes a basket 210, a door main body 220, a pocket unit 230, a handle member 240, and a slider 280 reciprocating between an opening position B and a closing position A (see FIGS. 4A and 4B for the opening and closing positions).

The basket 210 has a tube shape having an upper opening, and enters and exits the first storage compartment 110*a* in forward and backward directions. The door main body 220 is coupled to a front area of the basket 210.

The door main body 220 is provided in a planar shape filled with a foaming agent therein, and opens and closes the front opening of the first storage compartment 110*a* according to entrance and exit of the basket 210. A surface of a side of the first storage compartment 110*a* of the door main body 220, that is, an inner surface of the door main body 220 is coupled to the basket 210. A gasket 221 is mounted around a circumferential area in the inner surface of the door main body 220. The gasket 221 is in contact with front surfaces of lateral walls 111 of the first storage compartment 110*a*. The gasket 221 improves an airtight force of the first door 200 and the first storage compartment 110*a*. The pocket unit 230 is recessed in a surface of the door main body 220. The pocket unit 230 is formed at an upper surface of the main body 220.

The pocket unit 230 supplies a space to allow a user to open the first door 200. The pocket unit 230 has a length in a widthwise direction of the door main body 220, that is, a left and right direction thereof. The pocket unit 230 has a length corresponding to the width of the door main body 220. A front wall surface of the pocket unit 230 is formed by a door front cover 225 coupled to a front of the door main body 220. The handle member 240 is accommodated in the pocket unit 230.

The handle member 240 includes a lever 250 accommodated in the pocket unit 230, a hinge unit 260 coupling the lever 250 with respect to the door main body 220 to rotate in forward and backward directions, and a pressing unit 270 moving in the opposite direction to the lever 250 about the hinge unit 260 depending on rotation of the lever 250 to press and release the slider 280.

The lever 250 includes a lever main body 251 disposed in a surface direction of the door main body 220 so that a surface thereof can be distanced from the front wall surface of the pocket unit 230 in the opening position B, and a lever cover 253 bent from an end area of the lever main body 251 to cover between the front wall surface of the pocket unit 230 and the lever main body 251. The lever 250 has a length corresponding to the length of the pocket unit 230, i.e., corresponding to the width of the door main body 220. Thus, it is possible to open the first door 200 by handling any region of one lever 250 because the lever 250 has the length corresponding to the width of the door main body 220.

The lever main body 251 is provided in a planar shape, and is accommodated in the pocket unit 230. A surface of the lever main body 251 is disposed in a surface direction of the door main body 220. The lever main body 251 is distanced from the front wall surface of the pocket unit 230, that is, the door front cover 225 by a predetermined interval. The lever main body 251 may be provided to total areas along a lengthwise direction of the pocket unit 230. Also, the lever main body 251 has a height similar to the front wall surface of the pocket unit 230, that is, the door front cover 225. The lever cover 253 is bent and elongated in an outer end area of the lever main body 251, that is, an upper end area.

The lever cover 253 is bent and elongated forward from the upper end area of the lever main body 251 to cover between the front wall surface of the pocket unit 230 and the lever main body 251. The lever cover 253 is provided in a curved surface. The lever cover 253 may have a sectional shape of a part of a circular arc about the hinge unit 260. That is, the lever cover 253 covers between the front wall surface of the pocket unit 230 and the lever main body 251 in the closing position A, and rotates about the hinge unit 260 to protrude forward from the door main body 220 when moving from the closing position A to the opening position B. Accordingly, the lever cover 253 can move with maintaining a uniform gap in an up and down direction with respect to the front wall surface of the pocket unit 230, that is, the door front cover 225.

The hinge unit 260 is provided to a lower part of the lever 250, and couples the lever 250 with respect to the door main body 220 to rotate in the forward and backward directions. The hinge unit 260 is provided in a plurality of areas along the lengthwise direction of the lever 250. Accordingly, the hinge unit 260 can strongly support the lever 250 with respect to the door main body 220.

The hinge unit 260 includes a hinge pivot 261 and a hinge pivot coupling unit 263.

The hinge pivot 261 is provided at a lower area of the lever main body 251 in the lengthwise direction of the lever 250. That is, the hinge pivot 261 is provided to have an axial direction which is in parallel with the widthwise direction of the door main body 220. The hinge pivot 261 is provided in plural to be distanced along the lengthwise direction of the lever main body 251. The hinge pivot 261 is coupled to the door main body 220 by the hinge pivot coupling unit 263.

The hinge pivot coupling unit 263 has a hinge pivot accommodating unit 265 and a coupling unit 267.

The hinge pivot accommodating unit 265 is provided in a ring shape to form a hinge pivot accommodating groove 265*a* surrounding an outer surface of the hinge pivot 261. As shown in FIG. 3, a hinge pivot accommodating groove 227 facing the hinge pivot coupling unit 263 and coupled thereto to surround the hinge pivot 261 is formed to the door main body 220. That is, the hinge pivot accommodating groove 265*a* of the hinge pivot coupling unit 263 and the hinge pivot accommodating groove 227 of the door main body 220 are provided in a groove having a semicircular shape section, and are coupled with each other to surround a circumference of the hinge pivot 261.

In this manner, by applying the coupling method that the hinge pivot coupling unit 263 formed with one pair of hinge pivot accommodating grooves 265*a* is provided, and the hinge pivot accommodating groove 227 is formed to the door main body 220 to be coupled face to face to surround the circumference of the hinge pivot 261. Thus, assembling, disassembling, replacement and repair can be easily performed as compared to the case that a hinge pivot insertion hole (not shown) in which the hinge pivot 261 is coupled is provided to the door main body 220, and the hinge pivot 261 is forcedly inserted therein.

Lubricating oil is applied to the hinge pivot accommodating grooves 265*a* and 227. However, lubricating oil may also be applied to the hinge pivot 261. Accordingly, the lever 250 can smoothly rotate, and an operation noise can be reduced.

The coupling unit 267 is elongated from the hinge pivot accommodating unit 265 in the surface direction of the door main body 220 to be coupled to the door main body 220 by a screw (not shown).

The hinge pivot coupling unit 263 may further include an engagement unit 269 elongated from the hinge pivot accommodating unit 265 toward the first storage compartment 110*a* to be engaged to an inner part of the door main body 220. The engagement unit 269 allows the hinge pivot 261 to be more strongly supported with respect to the door main body 220.

The pressing unit 270 moves in the direction opposite to the lever 250 about the hinge unit 260 depending on rotation of the lever 250, and presses and releases the slider 280. That is, the lever 250, the hinge pivot 261 and the pressing unit 270 are integrally formed in the vertical direction. If the lever 250 is rotated forward about the hinge pivot 261, the pressing unit 270 rotates in the same direction as the lever 250 to rotate backward.

One pair of pressing units 270 are provided to the opposite sides in the widthwise direction of the door main body 220. That is, the pressing unit 270 is provided in a pair to a lower part of the opposite end areas of the lever 250. One pair of sliders 280 are provided to the opposite sides in the widthwise direction of the door main body 220. That is, the slider 280 is provided in a pair to correspond to one pair of pressing units 270.

The slider 280 reciprocates depending on rotation of the hinge member 240 between the opening position B protruding from the door main body 220 to press the main body cabinet 100, and the closing position A accommodated in an inner part of the door main body 220. The slider 280 is disposed to an outer area of the gasket 221. The slider 280 has a length along the forward and backward directions, and moves between the opening position B and the closing position A depending on pressing and releasing of the pressing unit 270.

The opening position B is a position of the slider 280 in which the slider 280 receives a backward pressing force from the pressing unit 270 to protrude from an inner surface of the door main body 220 and press the front surfaces of the lateral walls 111 of the first storage compartment 110*a*, thereby distancing the door main body 220 from the main body cabinet 100. In detail, if the lever 250 rotates forward about the hinge pivot 261, the pressing unit 270 moves backward. Here, the pressing unit 270 presses the slider 280 backward to move to the opening position B.

The closing position A is a position of the slider 280 in which the pressing force of the pressing unit 270 is withdrawn and the slider 280 is accommodated in an inner part of the door main body 220. In detail, if the lever 250 rotates backward about the hinge pivot 261, the pressing unit 270 moves forward. Here, the pressing unit 270 withdraws the pressing with respect to the slider 280 to move the slider 280 to the closing position A.

The slider 280 includes a slider head 281 having the same surface direction as the door main body 220 to face the pressing unit 270, and a slider stick 285 extending from the slider head 281 toward the first storage compartment 110*a*.

As described above, one handle member 240 is enough to make one pair of sliders 280 press the front surfaces of the lateral walls 111 of the first storage compartment 110*a*, so that the first door 200 can be easily opened by a relatively small force. Further, the slider 280 does not press a front surface of an upper wall 113 of the first storage compartment 110*a*, but presses the front surfaces of the lateral walls 111, so that the first door can be opened even if the handle member 240 has a short rotating distance.

The doors 200, 300 and 400 may further include an elastic member 290 supplying an elastic force to the handle member 240 or the slider 280 so that the slider 280 can maintain the closing position A. The elastic member 290 is provided as a coil spring supplying an elastic force forward to the slider 280. An end part of the elastic member 290 is supported to the door main body 220, and the other end part thereof is supported to the slider 280. Here, an elastic member supporting unit 283 accommodating and supporting the other end part of the elastic member 290 is formed to a surface of the slider head 281.

The second door 300 may have the substantially same configuration as the first door 200.

In the present exemplary embodiment, the pocket unit 230 of the first door 200 is described to be formed at an upper surface of the door main body 220, but the pocket unit 230 may be formed at a lower surface, or left or right surfaces of the door main body 220. In this case, the handle member 240 and the slider 280 have the same configurations as above, except the disposition direction thereof.

As shown in FIG. 1, the third door 400 may include configurations of a pocket unit 430, a handle member 440 and a slider 480 similar to the first door 200. The pocket unit 430, the handle member 440 and the slider 480 of the third door 400 may have the substantially same configurations as the first door 200, except the disposition direction thereof.

In the present exemplary embodiment, the configurations of the pocket unit 230, the handle member 240 and the slider 280 are described to be mounted to all of the first door 200, the second door 300 and the third door 400, but may be mounted to only the first door 200 and the second door 300 which are the drawer type doors, or may be mounted to only the third door 400 which is the rotation opening and closing type door.

In the present exemplary embodiment, a standing type kimchi refrigerator including all of the rotating doors and the entrance and exit opening and closing type door is described. However, the embodiments are not limited thereto, and the configurations of the pocket 230, the handle member 240 and the slider 280 may be applied to all types of refrigerators including at least one of the rotating door and the entrance and exit type door.

Hereinafter, an opening and closing operation of the first door 200 of the refrigerator 1 will be described in detail by referring to FIGS. 4A and 4B. FIGS. 4A and 4B are sectional views illustrating an opening and closing operation state of the first door 200 of the refrigerator 1.

The slider 280 usually maintains the closing position A by an elastic force of the elastic member 290.

A user inserts a hand in the pocket unit 230, and presses a surface of the lever 250 in a drawing direction of the basket 210, that is, in a forward direction with a force of such a strength as to overcome the elastic force of the elastic member 290.

Then, the lever 250 rotates forward about the hinge pivot 261, and accordingly, the pressing unit 270 rotates backward.

The pressing unit 270 presses the slider 280, and the slider 280 protrudes from the door main body 220 to move to the opening position B.

The gasket 221 is distanced from the main body cabinet 100 by a pressing force of the slider 280, and an internal pressure of the first storage compartment 110*a* is broken.

The user further presses forward the surface of the lever 250 to draw the basket 210 from the first storage compartment 110*a* to a desired position.

As described above, by providing the handle member 240 rotating forward and backward with respect to the door main body 220, and the slider 280 protruding from the door main body 220 to press the main body cabinet 100 depending on the rotation of the handle member 240, a door can be easily opened by a relatively small force.

Also, by providing the handle member 240 to the pocket unit 230 recessed from the thickness surface of the door main body 220, the handle member 240 does not protrude outside the door main body 220, thereby enhancing an external appearance.

As described above, the present embodiment provides a refrigerator allowing a user to easily open a door with a relatively small force, and enhancing beauty of an external appearance.

Although an exemplary embodiment has been shown and described, it will be appreciated by those skilled in the art that changes may be made in this exemplary embodiment without departing from the principles and spirit of the embodiment, the scope of which is defined in the appended claims and their equivalents.

What is claimed is:

1. A refrigerator comprising:

a main body cabinet forming a storage compartment with a front opening; and a drawer type door movably coupled to the main body cabinet, the drawer type door comprising a basket which is movable with respect to the storage compartment in forward and backward directions, the drawer type door comprising;

a door main body having a gasket installed at an inner surface thereof to establish a gasket seal when the door main body is in a closed position to close the front opening of the storage compartment;

a horizontally extending pocket formed in an upper part of the door main body, the pocket having an upper opening to allow fingers of a user to be inserted;

a handle member rotatably installed in the pocket such that the handle member is operable by user fingers inserted in the upper opening of the pocket to rotate in forward and backward directions with respect to the door main body; and a pair of sliders which are disposed in an inner part of the door main body to face front surfaces of lateral walls of the storage compartment and reciprocate depending on a rotation of the handle member between an opening position protruding from the door main body to press the front surfaces of the lateral walls of the storage compartment to cause the gasket seal to break between the door main body and the main body cabinet, and a closing position accommodated in the inner part of the door main body.

2. The refrigerator according to claim 1, wherein the handle member comprises:

a lever which is accommodated in the pocket;

a hinge unit which couples the lever with respect to the door main body to rotate in the forward and backward directions; and a pressing unit which moves in an opposite direction relative to the lever about the hinge unit depending on a rotation of the lever, and presses and releases the slider.

3. The refrigerator according to claim 2, further comprising a pair of the pressing units at opposite sides in a widthwise direction of the door main body.

4. The refrigerator according to claim 3, wherein the hinge unit is provided in a plurality of areas of the lever along the widthwise direction of the door main body.

5. The refrigerator according to claim 2, wherein the hinge unit comprises a hinge pivot provided to the lever and having an axial direction along a widthwise direction of the door main body, and a hinge pivot coupling unit coupling the hinge pivot to the door main body, and the hinge pivot coupling unit and the door main body each comprise hinge pivot accommodating grooves facing each other to be coupled to each other to surround the hinge pivot.

6. The refrigerator according to claim 2, wherein the lever comprises:

a lever main body, a surface of which is disposed in a surface direction of the door main body to be distanced from a front wall surface of the pocket unit in the opening position; and a lever cover which is bent from an end area of the lever main body to cover between a front wall surface of the pocket unit and the lever main body.

7. A refrigerator, comprising:

a main body cabinet forming a storage compartment with a front opening; and a drawer type door movably coupled to the main body cabinet, the drawer type door comprising a basket which is movable with respect to the storage compartment in forward and backward directions, the drawer type door comprising;

a door main body having a gasket installed at an inner surface thereof to establish a gasket seal when the door main body is in a closed position to close the front opening of the storage compartment;

a horizontally extending pocket formed in an upper wall surface of the door main body, the pocket having an upper opening to allow fingers of a user to be inserted;

a handle member rotatably installed in the pocket such that the handle member is operable by user fingers inserted in the upper opening of the pocket, and comprises a hinge unit provided to a plurality of areas along a widthwise direction of the door main body to rotate in forward and backward directions with respect to the door main body; and a pair of sliders which are disposed in an inner part of the door main body to face front surfaces of lateral walls of the storage compartment and reciprocate depending on a rotation of the handle member between an opening position protruding from the door main body to press the front surfaces of the lateral walls of the storage compartment to cause the gasket seal to break between the door main body and the main body cabinet, and a closing position accommodated in the inner pad of the door main body.

8. The refrigerator according to claim 7, wherein the handle member comprises: a lever which is accommodated in the pocket; and a pressing unit which moves in the opposite direction to the lever about the hinge unit depending on a rotation of the lever, and presses and releases the slider.

9. The refrigerator according to claim 8, further comprising a pair of the pressing units at opposite sides in a widthwise direction of the door main body.

10. The refrigerator according to claim 8, wherein the hinge unit comprises a hinge pivot provided to the lever and having an axial direction along a widthwise direction of the door main body, and a hinge pivot coupling unit coupling the hinge pivot to the door main body, and the hinge pivot coupling unit and the door main body each comprise hinge pivot accommodating grooves facing each other to be coupled to each other to surround the hinge pivot.

11. A refrigerator which comprises:

a main body cabinet forming a storage compartment with a front opening; and a drawer type door movably coupled to the main body cabinet, the drawer type door comprising a basket which is movable with respect to the storage compartment in forward and backward directions, the drawer type door comprising;

a door main body having a gasket installed at an inner surface thereof to establish a gasket seal when the door main body is in a closed position to close the front opening of the storage compartment;

a horizontally extending pocket formed in an upper part of the door main body, the pocket having an upper opening to allow fingers of a user to be inserted;

a handle member rotatably installed in the pocket such that the handle member is operable by user fingers inserted in the upper opening of the pocket to rotate in forward and backward directions with respect to the door main body, the handle member comprising;

a lever which is accommodated in the pocket;

a hinge unit which couples the lever with respect to the door main body to rotate in the forward and backward directions;

a pressing unit which moves in an opposite direction relative to the lever about the hinge unit depending on a rotation of the lever, and presses and releases a pair of sliders;

wherein the pair of sliders are disposed in an inner part of the door main body to face front surfaces of lateral walls of the storage compartment and reciprocate depending on a rotation of the handle member between an opening position protruding from the door main body to press the front surfaces of the lateral walls of the storage compartment to cause the gasket seal to break between the door main body and the main body cabinet, and a closing position accommodated in the inner part of the door main body.

12. The refrigerator according to claim 11, further comprising a pair of the pressing units respectively at opposite sides in a widthwise direction of the door main body.

13. The refrigerator according to claim 11, wherein the hinge unit comprises a hinge pivot provided to the lever and having an axial direction along a widthwise direction of the door main body, and a hinge pivot coupling unit coupling the hinge pivot to the door main body, and the hinge pivot coupling unit and the door main body are formed with hinge pivot accommodating grooves facing each other to be coupled to each other to surround the hinge pivot.

14. The refrigerator according to claim 11, wherein the lever comprises:

a lever main body, a surface of which is disposed in a surface direction of the door main body to be distanced from a front wall surface of the pocket in the opening position; and a lever cover which is bent from an end area of the lever main body to cover between a front wall surface of the pocket and the lever main body.

* * * * *

UNITED STATES PATENT AND TRADEMARK OFFICE

CERTIFICATE OF CORRECTION

PATENT NO. : 8,328,301 B2
APPLICATION NO. : 12/659661
DATED : December 11, 2012
INVENTOR(S) : Suk-Min Lee et al.

It is certified that error appears in the above-identified patent and that said Letters Patent is hereby corrected as shown below:

In the Claims

Column 9; Line 35; In Claim 6, delete "pocket unit" and insert -- pocket --, therefor.

Signed and Sealed this
Fourteenth Day of May, 2013

Teresa Stanek Rea
*Acting Director of the United States Patent and Trademark Office*